US005344273A

United States Patent [19]

Radlein

[11] Patent Number: 5,344,273

[45] Date of Patent: Sep. 6, 1994

[54] DOUBLE-TIER SIDE LOADING REFUSE VEHICLE

[75] Inventor: Denton G. Radlein, London, Canada

[73] Assignee: Shu-Pak Refuse Equipment Inc., Woodstock, Canada

[21] Appl. No.: 926,622

[22] Filed: Aug. 10, 1992

[51] Int. Cl.[5] ..... B65F 3/04

[52] U.S. Cl. ..... 414/409; 414/407; 414/422; 414/406; 414/517; 414/525.3

[58] Field of Search ..... 414/404, 406, 407, 408, 414/409, 418, 419, 420, 421, 422, 423, 424, 425, 525.1, 525.3, 525.4, 525.5, 525.6, 546, 517; 100/218

[56] References Cited

U.S. PATENT DOCUMENTS

| | | | |
|---|---|---|---|
| 3,083,849 | 4/1963 | Mottin | 414/407 X |
| 3,773,197 | 11/1973 | Blakeley et al. | 414/409 |
| 4,096,956 | 6/1978 | Gaskin | 100/215 X |
| 4,113,120 | 9/1978 | Pickrell . | |
| 4,173,423 | 11/1979 | Pickrell | 414/404 |
| 4,422,814 | 12/1983 | Borders | 414/303 |
| 4,450,828 | 5/1984 | Onken et al. | 414/406 X |
| 4,538,951 | 9/1985 | Yeazel et al. | 414/407 |
| 4,557,658 | 12/1985 | Lutz | 414/517 |
| 4,566,840 | 1/1986 | Smith | 414/408 |
| 4,627,783 | 12/1986 | De Filippi | 414/517 |
| 4,726,281 | 2/1988 | De Filippi | 92/52 X |
| 4,775,283 | 10/1988 | Krapp et al. | 414/492 |
| 4,877,366 | 10/1989 | De Filippi | 414/517 |
| 4,892,454 | 1/1990 | Behling et al. | 424/406 |
| 4,941,796 | 7/1990 | DeFilippi | 414/409 |
| 5,002,450 | 3/1991 | Naab | 414/408 X |
| 5,074,734 | 12/1991 | Price et al. | 414/24.6 |
| 5,074,737 | 12/1991 | Pellegrini et al. | 414/406 |
| 5,078,567 | 1/1992 | Lombardo | 414/525.6 |

FOREIGN PATENT DOCUMENTS

| | | | |
|---|---|---|---|
| 1118725 | 2/1982 | Canada . | |
| 1176210 | 10/1984 | Canada . | |
| 1188263 | 6/1985 | Canada . | |
| 2041350 | 10/1991 | Canada . | |
| 570745 | 2/1933 | Fed. Rep. of Germany | 414/407 |
| 2741448 | 3/1979 | Fed. Rep. of Germany | 414/407 |
| 9100231 | 1/1991 | PCT Int'l Appl. . | |

*Primary Examiner*—Frank E. Werner
*Attorney, Agent, or Firm*—Arne I. Fors; Jeffrey T. Imai

[57] ABSTRACT

A refuse collecting vehicle with a two-tier collection compartment. Recyclable material is placed in the upper portion of the collection compartment and conventional rubbish is collected in the lower portion of the collection compartment. The receptacle for depositing the recyclable material preferably is located between the cab and the collection compartment. The roof closure device for a roof opening at the top of the collection compartment is operatively connected to the lifting arms of the receptacle whereby the roof is opened while the receptacle is lifted to its uppermost discharge position and closed as the receptacle is lowered to its lowermost refuse-receiving position.

7 Claims, 8 Drawing Sheets

DOUBLE-TIER SIDE LOADING REFUSE VEHICLE

BACKGROUND OF THE INVENTION

This invention relates to a two-tier side loading refuse vehicle of the type wherein a refuse receptacle is raised between the cab of the vehicle and the vehicle body for dumping of its contents into an upper compartment.

The mechanical loading of refuse vehicles provides the important advantage of decreasing manpower used for loading the refuse into such vehicles. Front loading refuse vehicles are known, such as disclosed in U.S. Pat. No. 4,941,796 by Quinto De Filippi. This patent relates to a front loading refuse vehicle in which carriage means adapted to run on guide rails between a forward position to a rearward position supports lifting arms which are adapted to engage and lift a receptacle positioned in front of the vehicle. The use of lifting arms requires the operator of the refuse vehicle to be relatively precise during the receptacle engagement process. Also, the receptacle must be placed in a convenient location for access by the refuse vehicle. This limits the ability of such a refuse vehicle to adapt to all of the different types of housing plans in today's society. Given the bulk inherent in a refuse vehicle, any additional mobility restriction is inconvenient. U.S. Pat. No. 4,941,796 also discloses the use of piston-cylinder assemblies for operating hoist arms and a separate piston-cylinder assembly to open a trap door located on the top surface of the vehicle body through which the receptacle is dumped.

Recently there has been a desire to preserve the environment through recycling. Refuse vehicles which enable recyclable material to be collected in one portion of a refuse vehicle while conventional rubbish is collected in another portion of the vehicle are known. U.S. Pat. No. 4,557,658 by Lutz and U.S. Pat. No. 5,078,567 by Lombardo show various versions of vehicles having separate refuse compartments.

Compressing material in refuse vehicles through the use of hydraulic cylinders is known. U.S. Pat. No. 4,096,956 by Gaskin and U.S. Pat. No. 4,877,366 by De Filippi show compacting waste material through the use of hydraulic cylinders. However, in accordance with these patents, as well as in U.S. Pat. No. 4,941,796 previously discussed, compacting is an individual process apart from the loading and dumping process. The present invention enables the steps of roof opening, loading, dumping and compacting of recyclable material in a separate compartment to be achieved through the actuation of a single control switch.

SUMMARY OF THE INVENTION

In its broad aspect, the refuse vehicle of the present invention comprises a front portion including a cab, a rear body portion adapted to carry refuse material, said rear body portion having a roof opening for receiving refuse material, a roof closure door pivotally mounted for opening and closing the roof opening, a pair of spaced-apart parallel rails located on said rear body portion having upper portions extending into the roof opening, a carriage interconnecting the receptacle to each of the rails for vertical reciprocal guided travel of the receptacle on the rails from a lowermost loading position to an uppermost unloading position, at least one hoist arm pivotally mounted at one end on said rear body portion and having an opposite distal end, linkage means interconnecting the roof closure door and the hoist arm whereby the roof closure door pivots with the hoist arm, hoist arm actuating means mounted on said rear body portion and connected to the hoist arm for pivoting said hoist arm for raising and lowering said support arm with conjoint opening and closing of the roof closure door, and elongated linkage means pivotally secured at one end to the distal end of the hoist arm and at the other end to the receptacle whereby raising of the hoist arm with conjoint opening and closing of the roof closure door raises and lowers the receptacle for dumping of the refuse material in the receptacle through the roof opening. A switch control means is operatively connected to the hoist arm actuating means whereby compacting power means is actuated to compact refuse material in the top portion of the rear body portion while the receptacle is lowered to its lowermost position.

The term "refuse material" as referred to herein includes refuse, recyclable material and compost material.

The various features of the invention are more particularly shown in the claims which form a part of this disclosure. For a better understanding of the advantages and objects of the invention, reference should be made to the accompanying drawings and the following descriptive matter which illustrate the preferred embodiments of the invention.

BRIEF DESCRIPTION OF THE DRAWINGS

The present invention will now be described with reference to the following drawings, in which.

DETAILED DESCRIPTION OF THE PREFERRED EMBODIMENT

Figure 1:
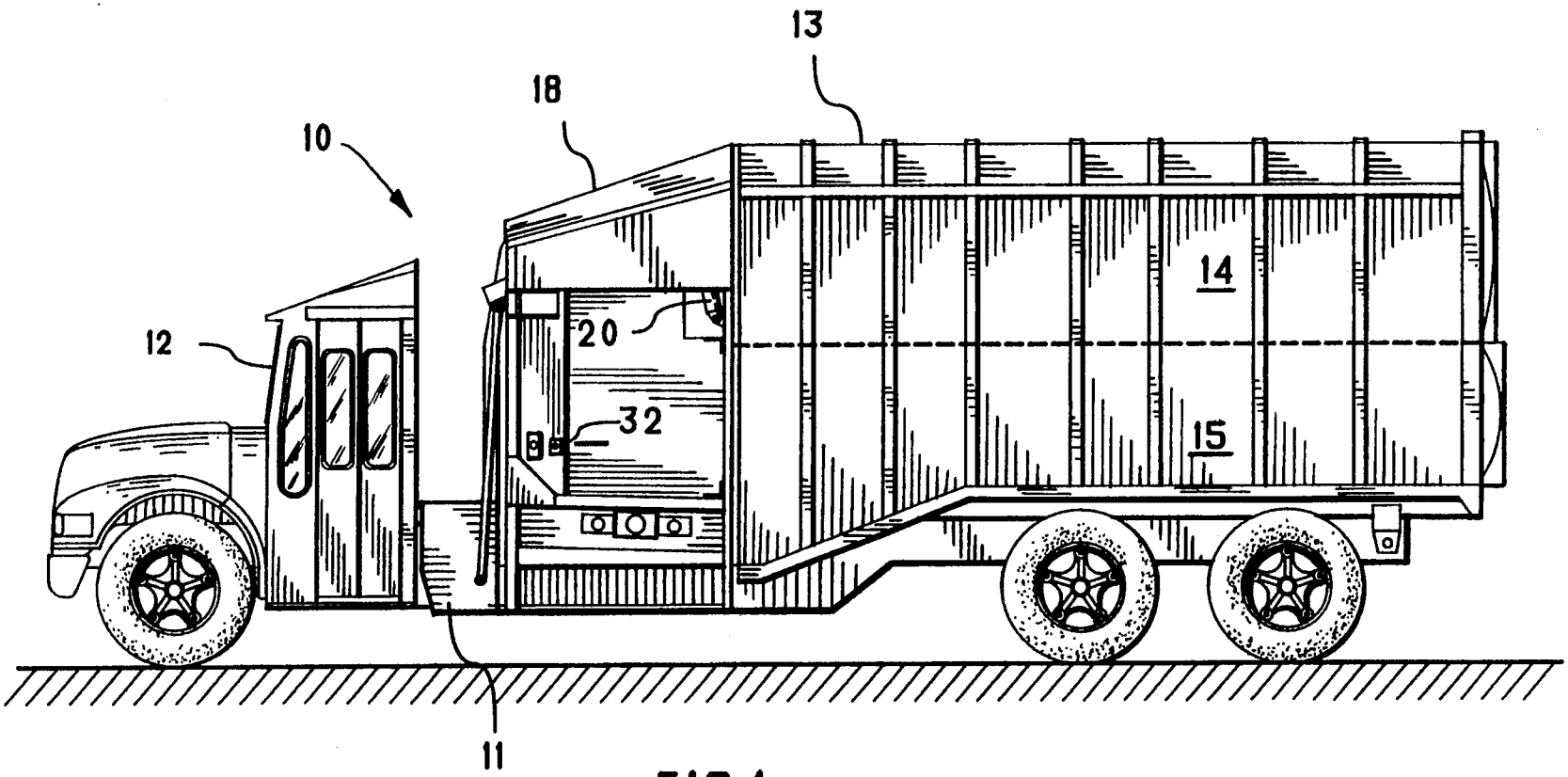
FIG. 1 is a side elevation of the refuse vehicle of the invention with a broken line indicating the two refuse compartments.

Referring to FIG. 1, the invention will be seen to be illustrated with reference to a refuse vehicle 10 of the type adapted to be used with a refuse receptacle 11 located between the cab 12 and vehicle body portion 13. The upper and lower compartments of the two-tier rear body portion of the refuse vehicle are depicted by numerals 14 and 15 respectively.

Figure 2:
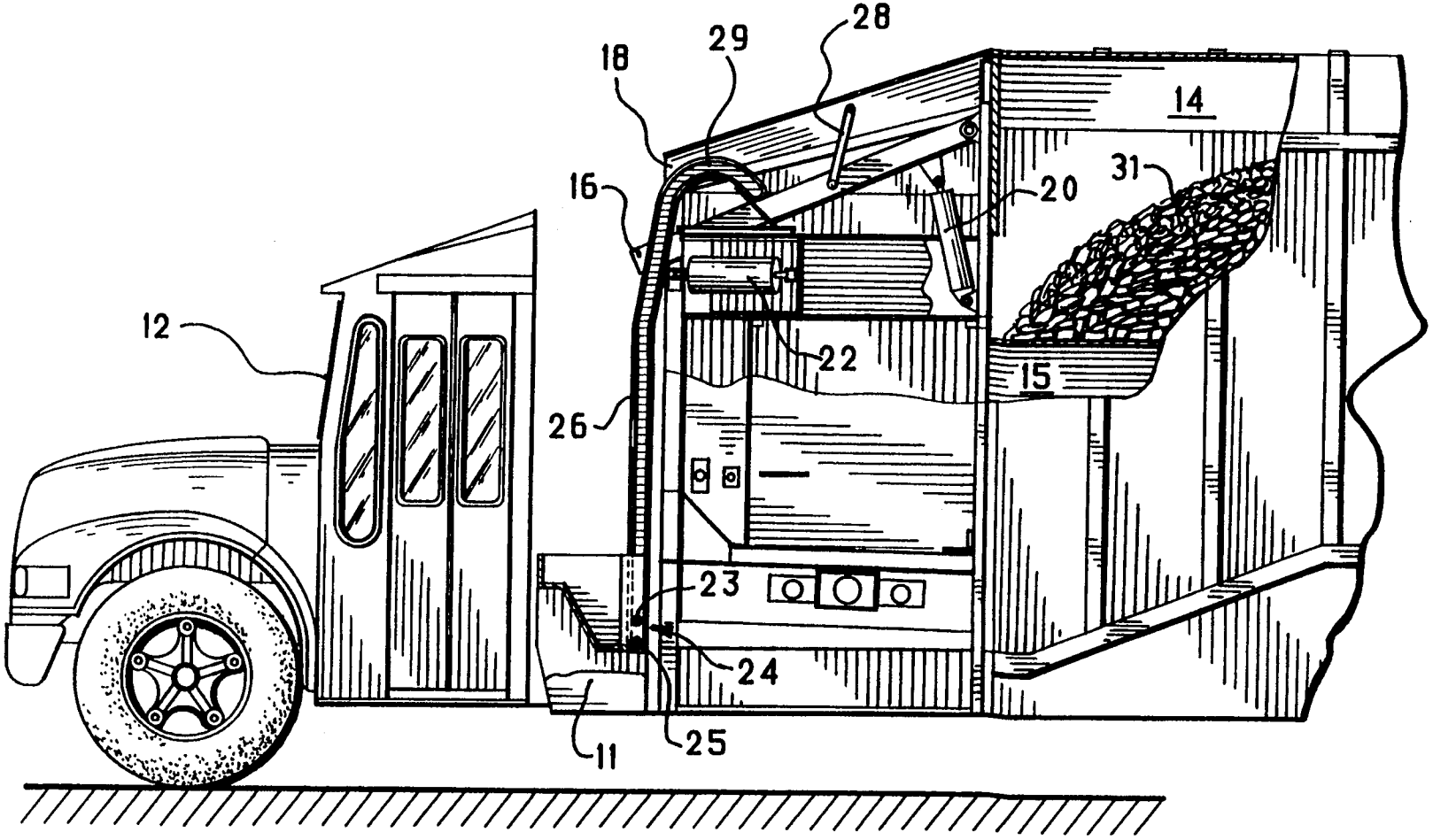
FIG. 2 is a fragmentary side view of the refuse vehicle shown in FIG. 1, partly cut away, showing a piston-cylinder assembly of the hoist arm actuating means as well as a piston-cylinder assembly used for packing.

FIG. 2 shows receptacle 11 in its lowermost refuse material receiving position. Hoist arms 16 and roof closure door 18 adapted to close roof opening 19 are shown in their closed positions, the closure of the roof closure door 18 substantially concealing the hoist arms 16 from view, with actuating piston-cylinder assemblies 20 in their fully retracted position. Compacting double-acting hydraulic piston-cylinder assemblies 22 are shown in their retracted position. The carriage 24 comprises two pairs of spaced-apart guide wheels 23, 25 journalled for rotation on receptacle 11 for guided travel on spaced-apart substantially vertical rails 26 secured to the rear body portion. The upper portions 29 of each of rails 26 is curved to extend rearwardly and downwardly through roof opening 19 for reasons which will become apparent as the description proceeds. Hoist arms 16 are connected to each side of roof closure door 18 by linkages 28 pivotally secured to the hoist arms 16 and door 18, as illustrated most clearly in FIG. 4.

Figure 3:
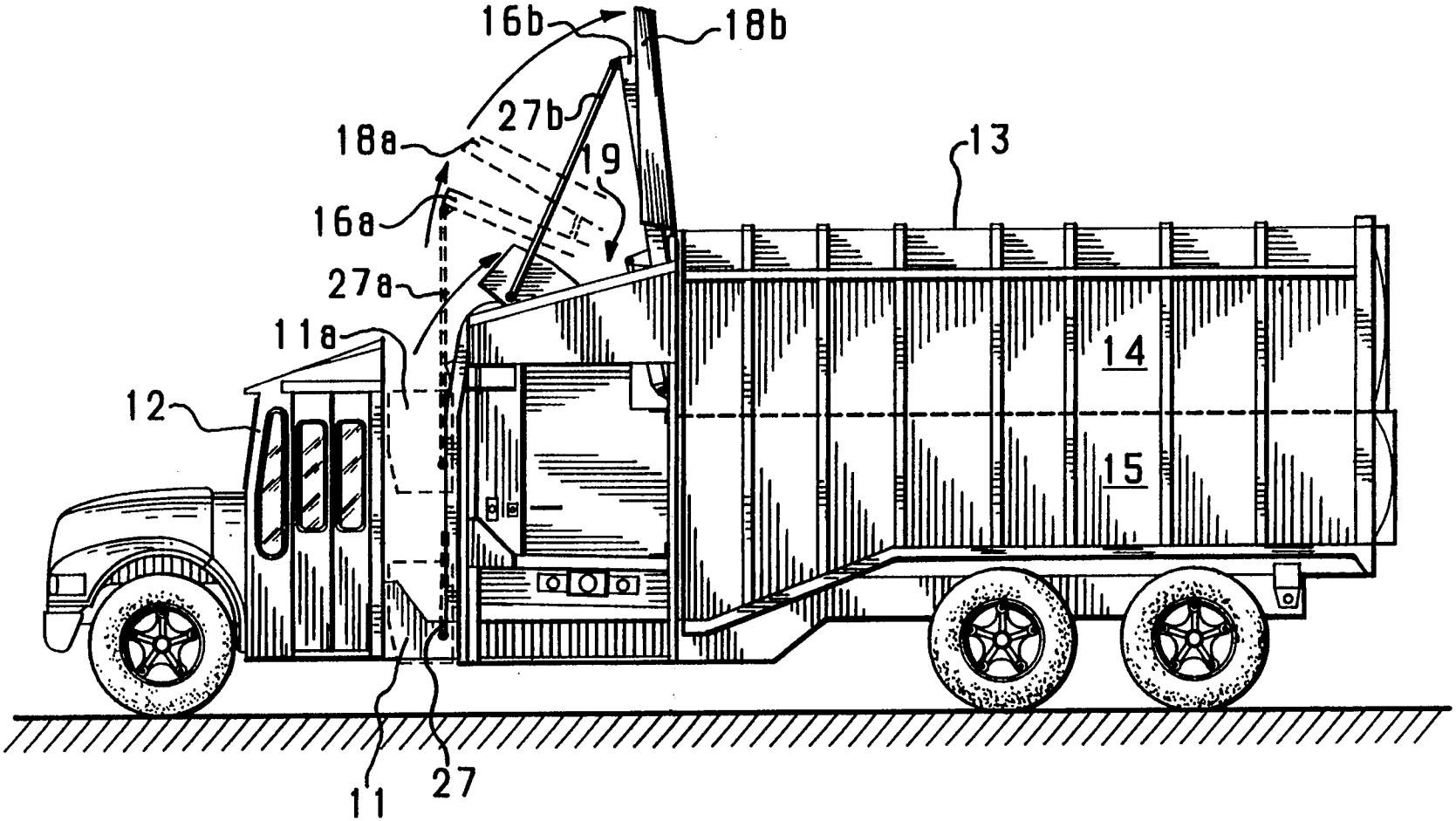
FIG. 3 is a side elevation of the refuse vehicle illustrating the receptacle and roof closure means in various stages of operation.
Figure 4:
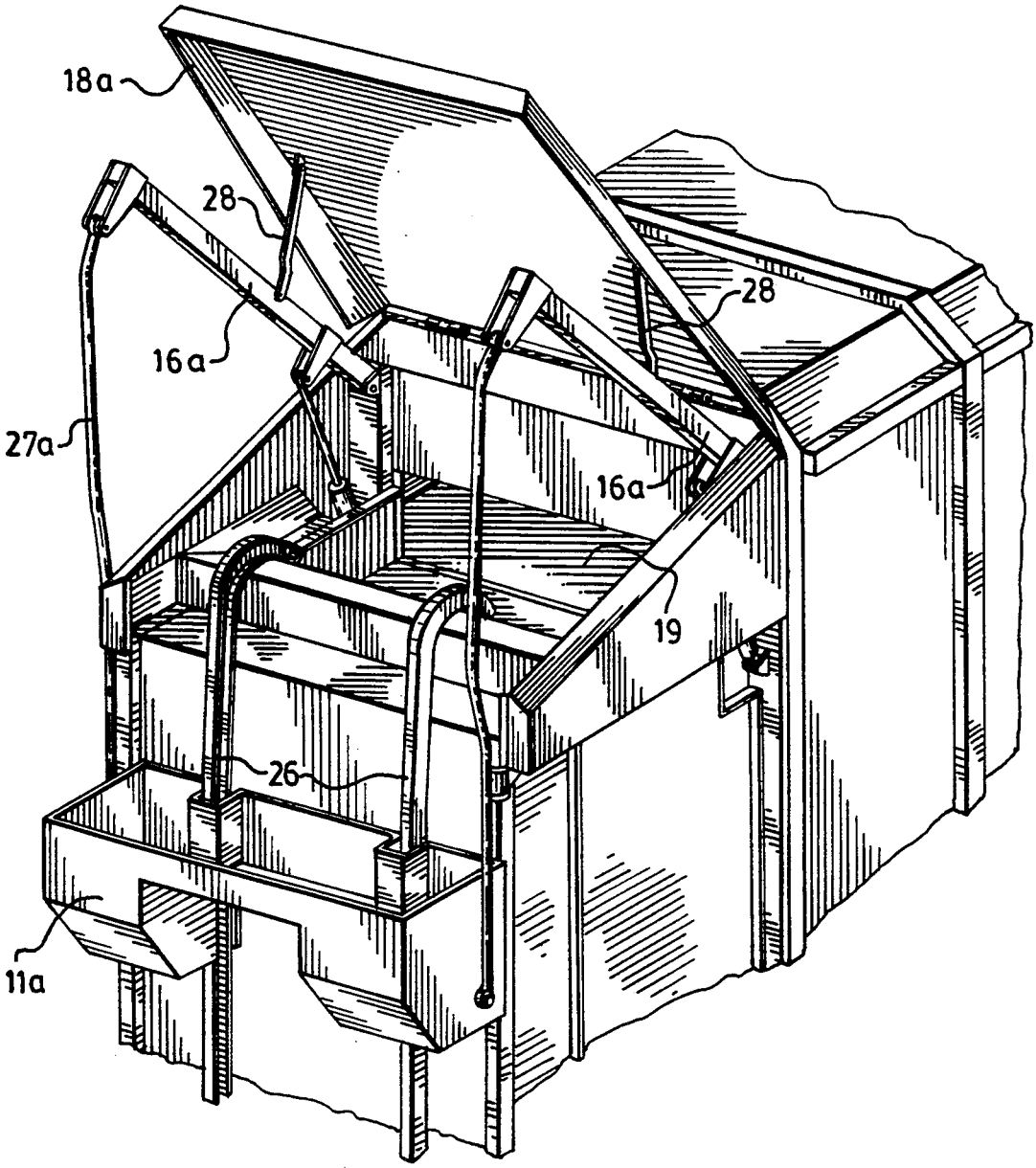
FIG. 4 is a perspective view of the roof closure in a partially open position.

In FIG. 3, the receptacle 11 is shown in an intermediate position 11*a*, shown more clearly in FIG. 4, and in its uppermost dumping position 11*b*. The roof closure door 18 is pivoted upwardly through intermediate position 18*a* to a fully open position 18*b* by the conjoint pivoting of hoist arms 16 through linkages 28 by actuation of piston-cylinder assemblies 20. Interconnecting linkages 28 allow hoist arms 16 and roof closure door 18 to travel in different radii to their respective open positions. The hoist arms 16 pivot upwardly with roof closure door 18 through intermediate position 16*a* to position 16*b* to lift receptacle 11 by interconnecting elongated linkage means 27 through its intermediate position 27*a* to position 27*b* with vertical guided travel of receptacle 11 on rails 26 by means of guide wheels 23, 25 to position 11*b* whereby the receptacle dumps the contents thereof into the upper tier compartment 14 of the two-tier collection compartment.

Figure 5:
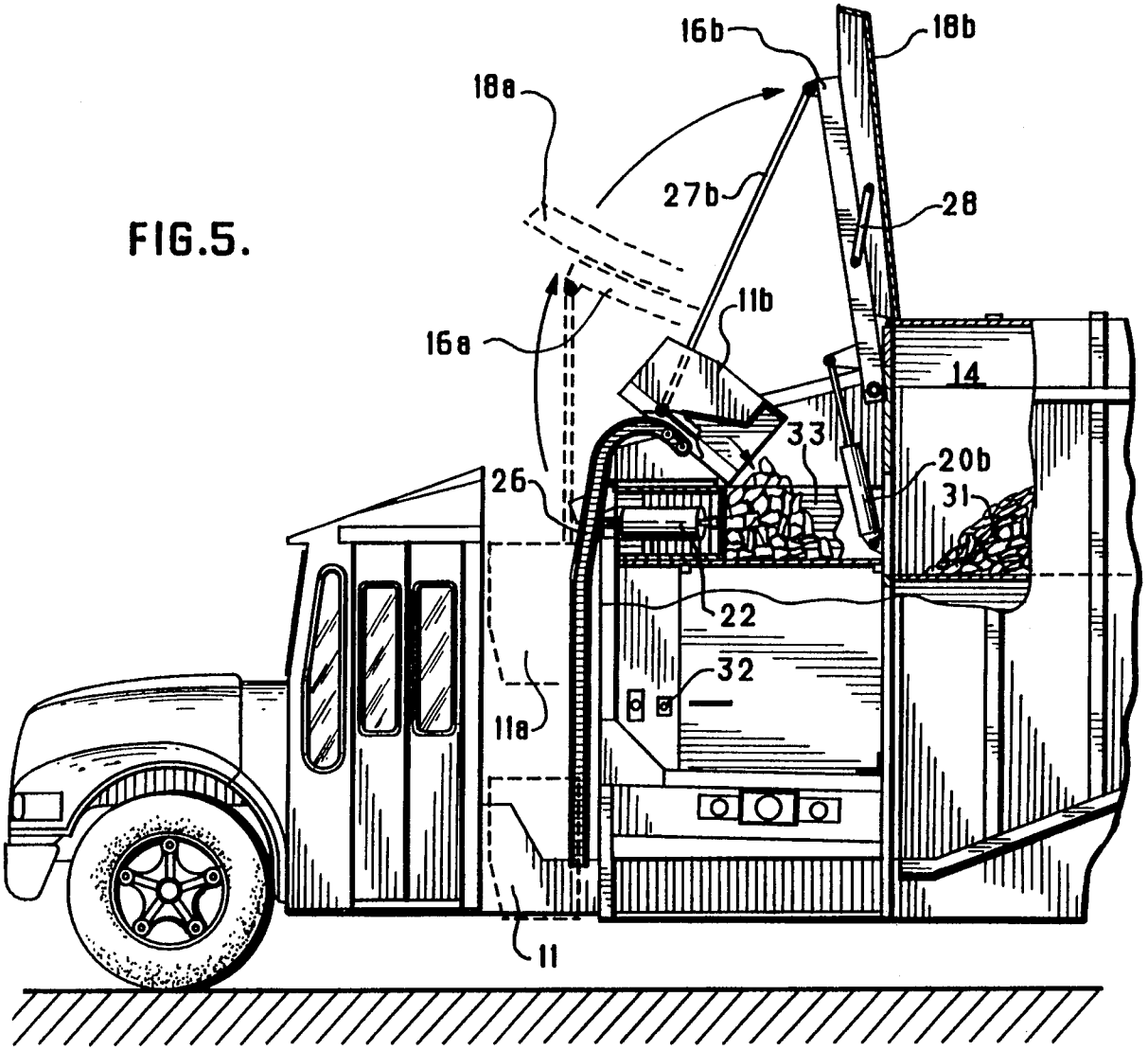
FIG. 5 is a side elevation, partially cut away, showing the dumping of the refuse material, e.g. recyclable material, preparatory to compacting thereof.

FIG. 5 shows the dumping of the refuse material into the entrance 33 of upper compartment 14. The piston-cylinder assemblies 20 are shown in their extended positions 20*b* and compacting double-acting hydraulic piston-cylinder assemblies 22 are in their retracted positions.

Figure 6:
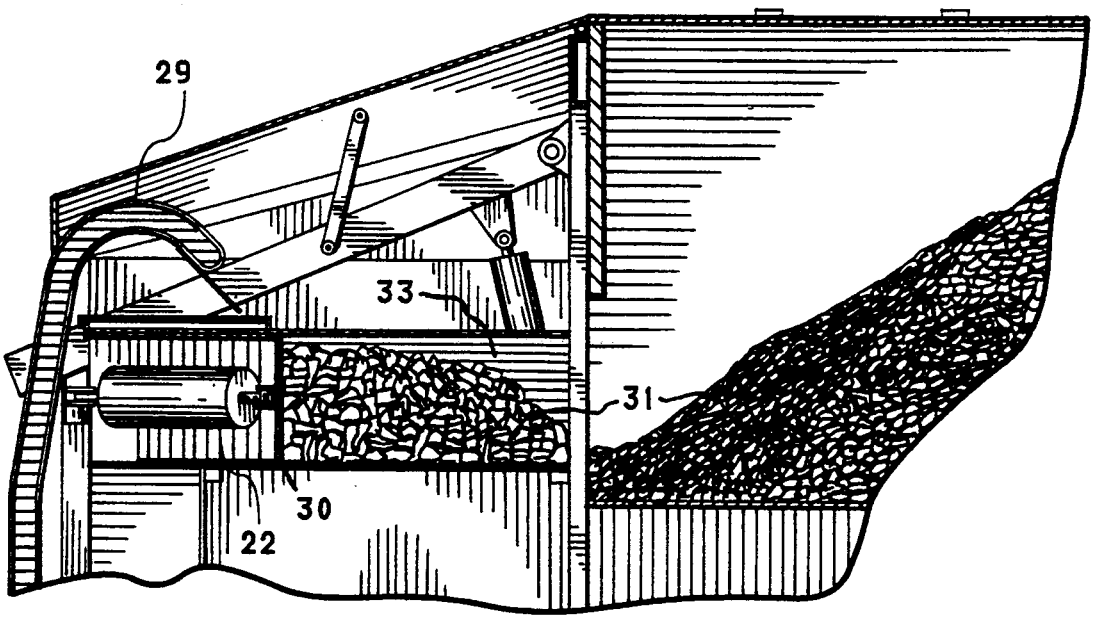
FIG. 6 is a fragmentary side view showing the hydraulic cylinder used for compacting in a retracted position.
Figure 7:
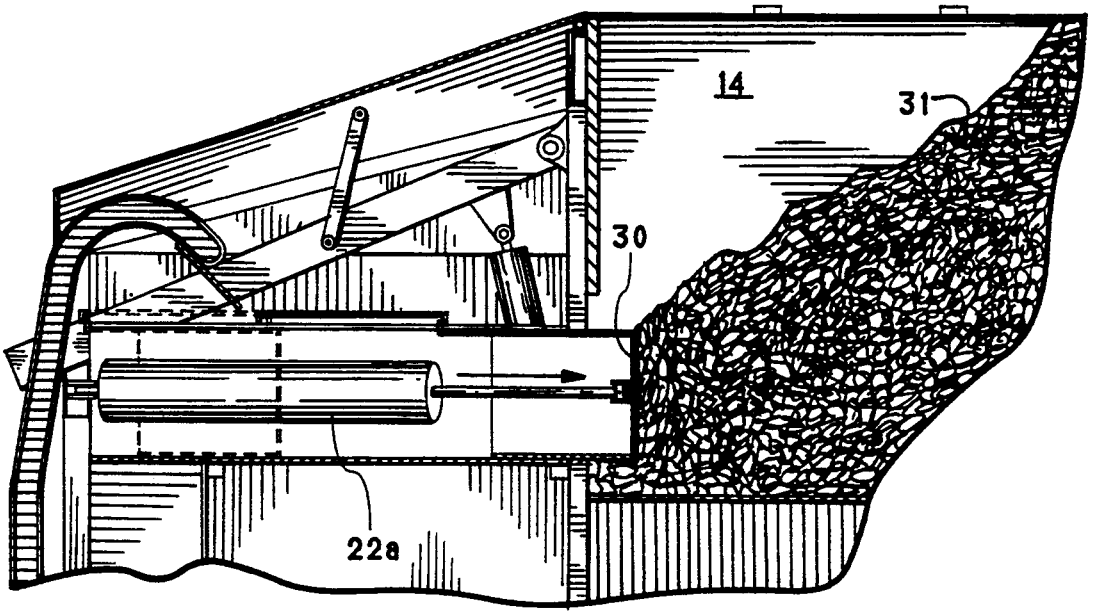
FIG. 7 is an fragmentary side view showing the compacting hydraulic cylinder in a fully extended position.
Figure 8:
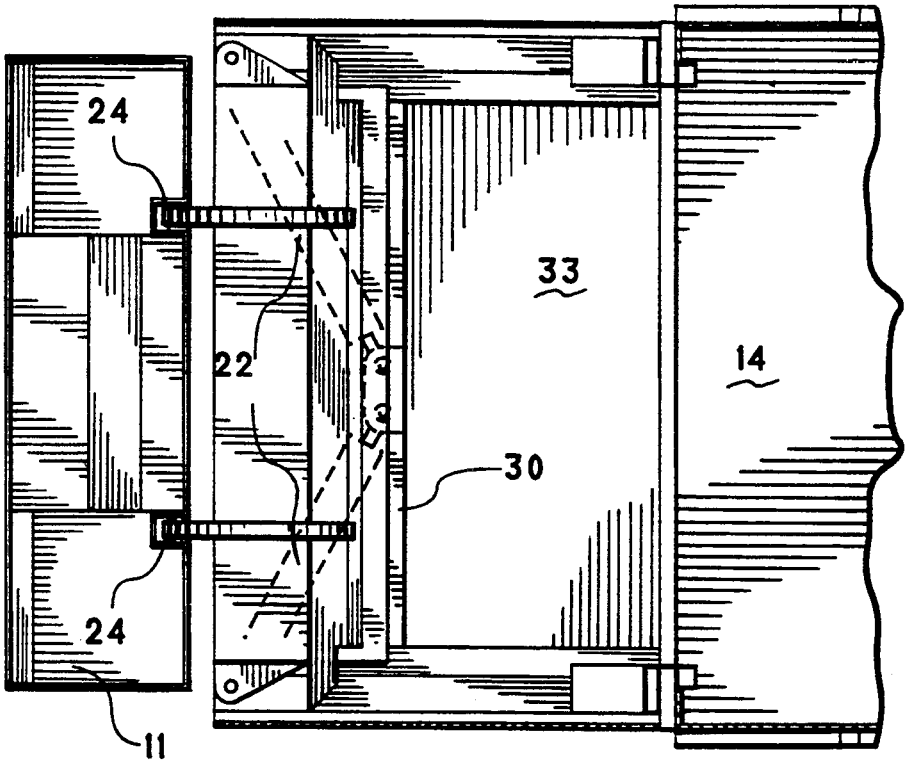
FIG. 8 is a plan view of the compacting hydraulic cylinder in a retracted position, corresponding to FIG. 6.
Figure 9:
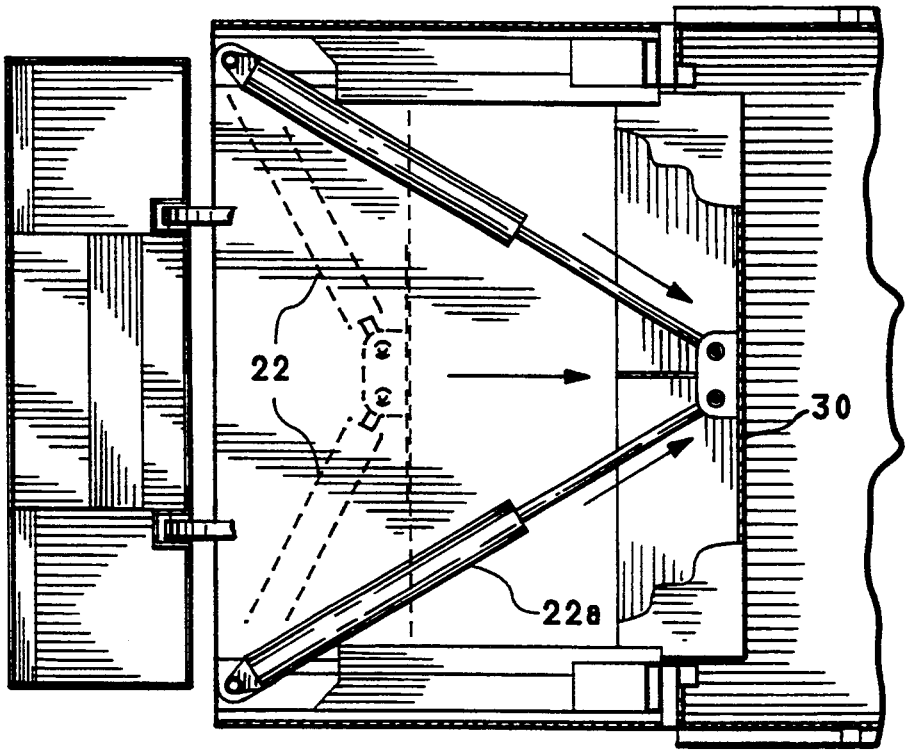
FIG. 9 is a plan view of the compacting hydraulic cylinder in a fully extended position, corresponding to FIG. 8.

Referring now to FIGS. 6 and 8, the pivotally-mounted compacting hydraulic piston-cylinder assemblies 22 are shown in their retracted positions. FIGS. 7 and 9 show assemblies 22 in their extended positions 22*a* with pusher or compacting plate 30 extended to compact before such as recyclable material 31 in compartment 14. The movement of piston-cylinder assemblies 22 and pusher plate 30 is indicated by arrows in FIG. 9, in which the normally at-rest retracted position of assemblies 22 and pusher plate 30 is shown by broken lines.

Figure 10:
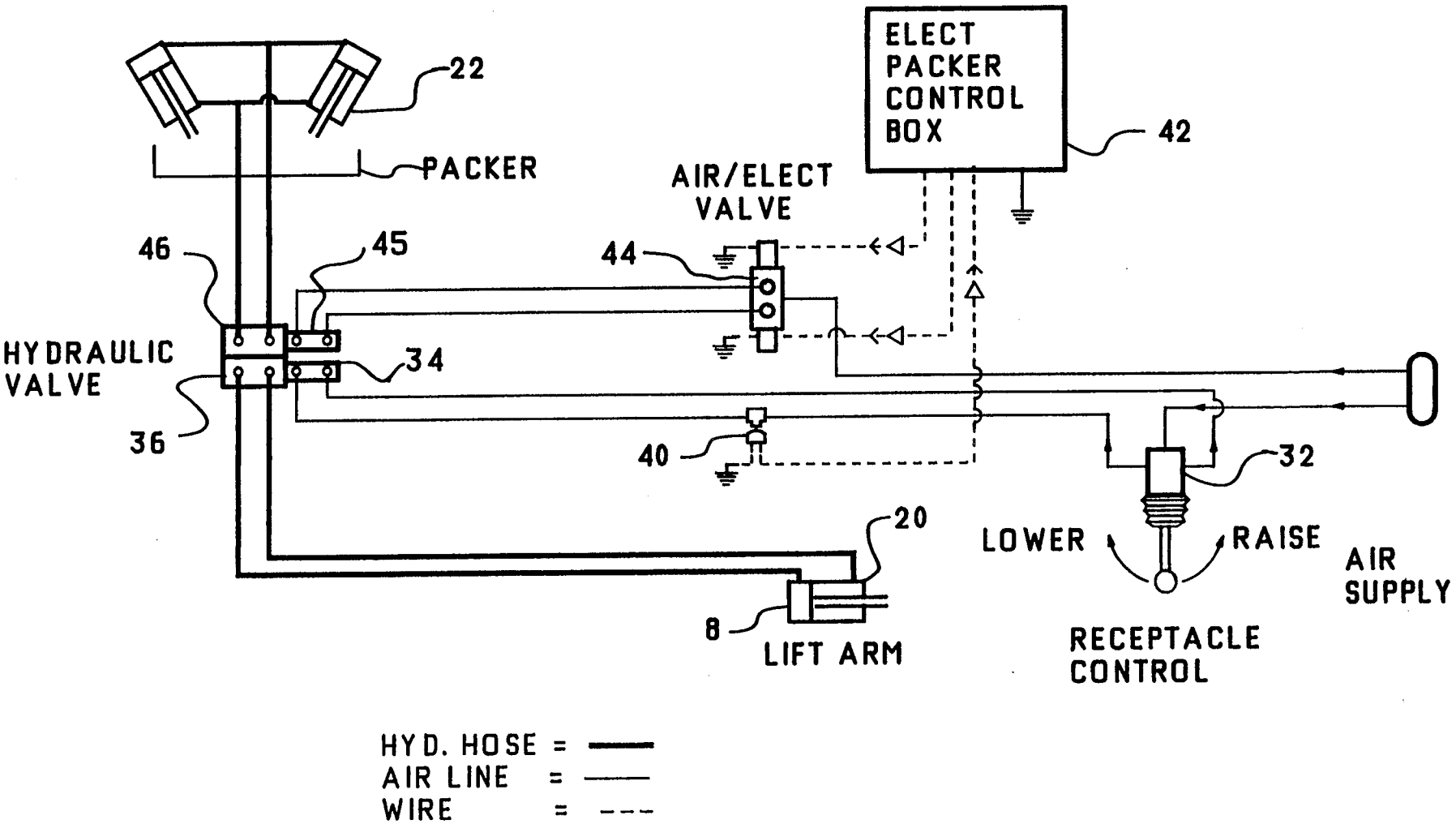
FIG. 10 is a schematic view of the receptacle control system of the invention.

The pneumatic electric hydraulic control system is shown schematically in FIG. 10 in which single joystick 32, located on the side of the vehicle's body as shown in FIG. 1, controls raising and lowering of receptacle 11, opening and closing of roof closure door 18, and actuation of compacting plate 30. Moving the joystick 32 to the "raise" position, i.e. to the right as viewed in FIG. 10, diverts pressurized air to the shift cylinder 34 on the hydraulic valve 36 which in turn diverts pressurized oil to the lift arm cylinders 38 of piston-cylinder assemblies 20 to open closure door 18 and elevate and dump receptacle 11.

Moving the joystick 32 to the "lower" position, i.e. to the left as viewed in FIG. 10, diverts pressurized air to simultaneously close an electrical circuit in air pressure switch 40 to send an electrical signal to the electrical packer control box 42 and to shift cylinder 34 on hydraulic valve 36 to reverse lift arm cylinders 38 to close closure door 18 and lower receptacle 11. The packer control box 42 transmits an electrical signal to the air/electric valve 44 which diverts pressurized air to shift cylinder 45 which in turn controls the hydraulic valve 46 for actuation of the packing cylinders 22. Thus lowering of the receptacle 11 and closing of roof closure door 18 coincides with initiation of the packing cycle.

The present invention provides a number of important advantages. The roof closure door of a refuse vehicle is automatically opened and closed with the raising, dumping and lowering of a refuse container, the compacting cycle of refuse deposited in a separate refuse compartment such as for recyclable material automatically commencing with lowering of the refuse receptacle. The complete cycle is controlled by a single control lever which utilizes pressurized pneumatic and hydraulic systems in conjunction with electrical controls protected from adverse climate conditions to ensure a positive and reliable operation.

What we claim as new and desire to protect by Letters Patent of the United States is:

1. A refuse vehicle comprising:

a front portion including a cab;

a rear body portion adapted to carry refuse material, said rear body portion having a roof opening for receiving refuse material;

a roof closure door pivotally mounted on said rear body portion for opening and closing the roof opening;

a pair of spaced-apart substantially vertical parallel rails located on said rear body portion having upper portions adjacent the roof opening;

a receptacle disposed between the cab and the rear body portion;

guide wheels interconnecting the receptacle to each of the rails for vertical reciprocal guided travel of the receptacle on the rails from a lowermost loading position to an uppermost unloading position;

a pair of hoist arms pivotally mounted at one end on said rear body portion one on each side of the roof opening within the roof opening thereby closure of the roof closure door substantially conceals the hoist arms from view;

each hoist arm having an opposite distal end; linkage means interconnecting the roof closure door and the hoist arms whereby the roof closure door pivots with the hoist arms;

hoist arm actuating means mounted on said rear body portion and connected to the hoist arms for pivoting said hoist arms for raising and lowering said hoist arms with conjoint opening and closing of the roof closure door; and elongated linkage means pivotally secured at one end to the distal end of the hoist arms and at the other end to the receptacle whereby raising of the hoist arms with conjoint opening and closing of the roof closure door raises and lowers the receptacle for dumping of refuse material in the receptacle through the roof opening.

2. A refuse vehicle as claimed in claim 1 wherein said hoist arm actuating means comprises a double-acting piston-cylinder assembly pivotally connected at one end to the rear body portion and at the other end to the hoist arm.

3. A refuse vehicle as claimed in claim 2 wherein said rear body portion has a front end and the roof closure door and the rails are located at the front end of the rear body portion behind the cab, and wherein the rail upper portions extend into the roof opening.

4. A refuse vehicle as claimed in claim 3 wherein said rear body portion is divided into an elongated upper compartment and an elongated lower compartment.

5. A refuse vehicle as claimed in claim 4, additionally comprising compacting power means for compressing refuse material in the upper compartment as said receptacle is lowered to its lowermost position.

6. A refuse vehicle as claimed in claim 5 wherein said upper compartment contains recyclable material and said lower compartment contains refuse material.

7. A refuse vehicle as claimed in claim 5, additionally comprising switch control means operatively connected to the double-acting piston-cylinder assembly and to the compacting power means whereby the compacting power means are actuated to compact refuse material in the upper compartment of the rear body portion while the receptacle is lowered to its lowermost position concurrent with lowering of the roof closure door.

* * * * *